US006222162B1

(12) United States Patent
Keane

(10) Patent No.: US 6,222,162 B1
(45) Date of Patent: Apr. 24, 2001

(54) ELECTRIC BLANKET AND CONTROL

(76) Inventor: Barry P. Keane, 1704 Keowee Lakeshore Dr., Seneca, SC (US) 29672

( * ) Notice: Subject to any disclaimer, the term of this patent is extended or adjusted under 35 U.S.C. 154(b) by 0 days.

(21) Appl. No.: 09/410,475

(22) Filed: Sep. 30, 1999

Related U.S. Application Data

(60) Provisional application No. 60/137,387, filed on Jun. 3, 1999.

(51) Int. Cl.[7] ..... H05B 1/02

(52) U.S. Cl. ..... 219/481; 219/505; 219/497; 219/501; 219/212; 323/236

(58) Field of Search ..... 219/501, 212, 219/502, 497, 494, 507–508, 504; 307/117; 323/235, 236

(56) References Cited

U.S. PATENT DOCUMENTS

| | | | | |
|---|---|---|---|---|
| 3,597,590 | * | 8/1971 | Fleming | 219/501 |
| 3,889,101 | | 6/1975 | Woods | 219/527 |
| 3,973,066 | | 8/1976 | Smith, II et al. | 428/91 |
| 4,031,352 | | 6/1977 | Oosterberg | 219/212 |
| 4,034,185 | | 7/1977 | Crowley | 219/212 |
| 4,070,217 | | 1/1978 | Smith, II et al. | 156/73.2 |
| 4,074,421 | | 2/1978 | Reutling et al. | 29/628 |
| 4,119,905 | * | 10/1978 | Head | 323/21 |
| 4,162,393 | | 7/1979 | Balboni | 219/217 |
| 4,271,350 | | 6/1981 | Crowley | 219/549 |
| 4,309,597 | | 1/1982 | Crowley | 219/549 |
| 4,315,141 | | 2/1982 | Mills et al. | 219/505 |
| 4,396,011 | | 8/1983 | Mack et al. | 128/24.2 |
| 4,436,986 | | 3/1984 | Carlson | 219/505 |
| 4,485,296 | * | 11/1984 | Ueda et al. | 219/505 |
| 4,503,322 | | 3/1985 | Kishimoto et al. | 219/505 |
| 4,523,084 | * | 6/1985 | Tamura et al. | 219/505 |
| 4,554,439 | | 11/1985 | Cross et al. | 219/497 |
| 4,625,394 | | 12/1986 | Kemnitz et al. | 29/611 |
| 4,657,572 | * | 4/1987 | Desai et al. | 65/1 |
| 4,684,785 | | 8/1987 | Cole | 219/212 |
| 5,113,058 | | 5/1992 | Srubas et al. | 219/548 |
| 5,521,850 | * | 5/1996 | Moe et al. | 219/508 |

OTHER PUBLICATIONS

"Underwriters Laboratories, Inc. Standard for Safety, Temperature–Indicating and–Regulating Equipment," *Global Engineering Documents*, UL873, ISBN 1–55989–682–5, 1994, 1995, 1996, 1998, 1999.

"Underwriters Laboratories, Inc. Standard for Safety, Electrically Heated Bedding," *Global Engineering Documents*, UL964, ISBN 1–55989–708–2, 1994.

* cited by examiner

*Primary Examiner*—Mark Paschall
(74) *Attorney, Agent, or Firm*—Nelson Mullins Riley & Scarborough, LLP

(57) ABSTRACT

An electric blanket includes a heating element extending through the blanket so that, upon receiving electric current from a power source, the element heats the blanket. A regulator circuit is connected to the element. It is configured to measure the resistance of the element and to control delivery of the electric current from the power source to the element responsively to the resistance so that the element heats to a desired temperature.

38 Claims, 3 Drawing Sheets

ELECTRIC BLANKET AND CONTROL

The present application is based on a provisional application filed on Jun. 3, 1999, and having U.S. Ser. No. 60/137,387, the entire disclosure of which is incorporated herein by reference.

BACKGROUND OF THE INVENTION

Electric blankets typically include a wire element that extends through the blanket and through which electric current passes to generate heat. A desired temperature setting is generally achieved by controlling the amount of current passing through the wire. Furthermore, one or more heat-sensing mechanisms are typically provided in the blanket to detect an undesirable increase in temperature so that current to the heating element can be discontinued.

SUMMARY OF THE INVENTION

The present invention recognizes and addresses disadvantages of prior art constructions and methods.

Accordingly, it is an object of the present invention to provide an improved electric blanket.

It is also an object of the present invention to provide an improved electric blanket control.

These and other objects are achieved by an electric blanket including a heating element that extends through the blanket so that, upon receiving electric current from a power source, the element heats the blanket. A regulator circuit is connected to the element. It is configured to measure the resistance of the element and to control delivery of electric current from the power source to the element responsively to the measured resistance so that the element heats to a desired temperature.

A method according to the present invention includes providing a heating element extending through the blanket so that, upon receiving electric current from a power source, the element heats the blanket. The resistance of the element is measured, and delivery of electric current from the power source to the element is controlled responsively to the resistance so that the element heats to a desired temperature.

The accompanying drawings, which are incorporated in and constitute a part of the specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
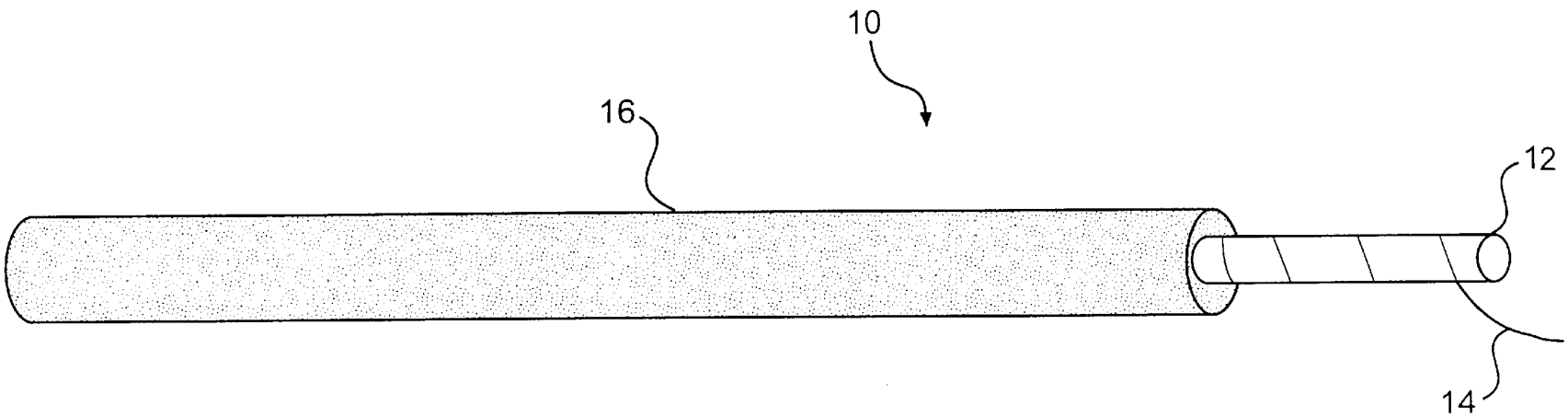
FIG. 1 is a cut away perspective view of a heating element for use in a preferred embodiment of an electric blanket constructed in accordance with the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made to the present invention without departing from the scope or spirit thereof. For instance, features illustrated or described as part of one embodiment may be used on another embodiment to yield a still further embodiment. Thus, it is intended that the present invention covers such modifications and variations.

Referring to FIG. 1, an electric blanket heating element 10 includes a polymer core 12 about which is wound a wire element 14. An insulation layer 16 encases the core and wire element. As should be understood by those skilled in this art, heating element 10 extends through the interior of an electric blanket in a predetermined pattern in order to heat the blanket to a predetermined setting. The structure and manufacture of an electric blanket apart from the heating element, and the placement of the heating element in the electric blanket, should be well understood by those skilled in this art and is therefore not discussed in detail herein. It should be understood, however, that any suitable such construction and placement is within the scope and spirit of the present invention.

The construction of wire 14 may vary as suitable for the requirements of a given blanket. For example, assume that a blanket is rated for 125 watts, that the blanket is of such a size that a 100 foot heating element (measured as the length of wire element 14) is required, and that a 120 volt power source drives the heating element. Power is equal to $V^2/R$, and the wire must therefore provide a resistance of approximately 115 ohms. Therefore, the heating element's resistance must be approximately 1.15 ohms per foot. The resistance estimate is an approximation since, as discussed below, the resistance varies with temperature.

Any wire of a suitable material and construction may be used to provide the desired resistance. Exemplary metal materials include cadmium copper alkaloid (CDA 162), KANTHAL 70 or 52, and nickel 270. The choice may depend on factors such as cost and the desires of a particular manufacturer.

Given a particular material and wire length, resistance is thereafter determined by the wire's cross-sectional area. Frequently, however, it is desirable to minimize cross-sectional area to make the heating element less apparent to the user. If the wire length is fixed, restrictions on cross-sectional area may limit the available materials.

To permit a broader choice of materials, a wire element having a non-circular, for example rectangular or other polygonal shaped, cross-section may be used to increase the wire's cross-sectional area without increasing the heating element's profile. The increase in cross-sectional area decreases the wire's resistance, thereby allowing the use of a broader range of materials than would otherwise be permitted.

In one exemplary embodiment, a 125 watt electric blanket uses an approximately 100 foot heating element made of 37 gauge cadmium copper wire. To prevent the heating element from being too bulky or overly noticeable to the consumer, 30 gauge, or smaller, wire is preferred when using wire having a circular cross-section.

Furthermore, a relatively high temperature coefficient is also preferable. Temperature coefficient is the measure of the tendency of the wire's resistance to vary with temperature. It is generally stated in percent increase in resistance per degree Fahrenheit or Celsius. A higher temperature coefficient facilitates detection of temperature increases in that a larger change in resistance per unit of temperature change is more easily and reliably detected. Preferably, materials having a temperature coefficient at or above that of cadmium copper (0.194%/° F.) are used. It should be understood, however, that this range refers only to certain preferred embodiments of the present invention and that materials with lower temperature coefficients may be used, provided the blanket includes a control system capable of effectively detecting temperature changes in such materials.

Core 12 can be made of any suitable polymer, for example polyester. Outer insulation 16 may also be made of a polymer, such as polyvinylcholoride (PVC). In one embodiment, the minimum average thickness of outer insulation 16 is approximately two mills. Heating element 14 measures at 37 gauge, and the outer diameter of heating element 10 is approximately 72 mills.

Figure 2:
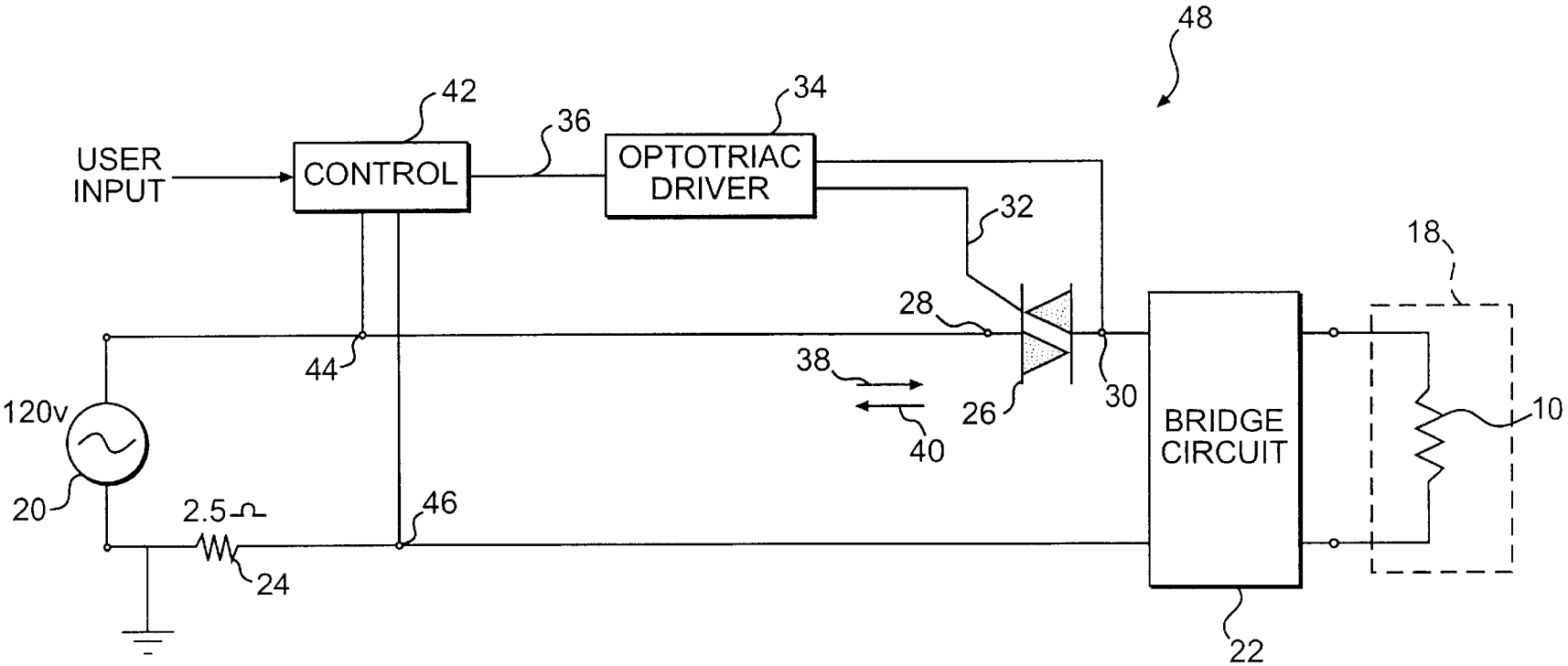
FIG. 2 is a schematic illustration of an electric blanket according to a preferred embodiment of the present invention.

Referring to the schematic illustration in FIG. 2, an electric blanket is indicated in phantom at 18. The heating element is incorporated in the blanket in a conventional manner and is indicated at 10 as a resistance. The heating element is connected to a 120 volt AC voltage source 20 through a full-wave bridge rectifier 22, a sampling resistor 24 and a triac switch 26. As should be understood by those skilled in this art, a triac switch conducts AC current between inputs 28 and 30 in both directions as long as an activating signal is present on a control lead 32. If the activating signal is discontinued, the triac conducts current until the input signal's next zero crossing.

The activating signal is provided by an optically isolated triac driver 34 that acts as a switch passing current from node 30 to the control lead 32. Thus, when driver 34 is activated by its control lead 36, the signal from source 20 drives triac 26. During this signal's positive cycle portion, current travels through triac 26 in the direction indicated by arrow 38. During its negative cycle portion, current travels through the triac in direction 40.

A control circuit 42 controls driver 34. Control circuit 42, for example comprising a single integrated circuit (IC), may include a microprocessor and an A/D converter. Through the converter, the IC receives voltage measurements from nodes 44 and 46. The measurement from node 46 is the voltage across sampling resistor 24. Thus, the controller may determine the current through heating element 10 by dividing the voltage measured at 46 by the known resistance of sampling resistor 24. The voltage applied to the system is measured at 44. Thus, the system's total resistance is equal to the voltage measured at 44 divided by the current measured at 46. The resistance of heating element 10 may therefore be determined by backing out the known resistances of the components upstream from the heating element.

As discussed above, the temperature of heating element 10 is related to its resistance. Wire manufacturers typically rate wire resistance with respect to a predetermined temperature, generally around 75° Fahrenheit. The manufacturer also typically provides the wire's temperature coefficient. Thus, given a known length L of heating element 10 having a temperature coefficient TC and a rated resistance X (in ohms per unit length) at Y° Fahrenheit, and given a measured resistance Z (in ohms) between nodes 44 and 46 as discussed above, heating element temperature $T=Y+(1/XL)(Z-XL)/TC$.

The variables Y, TC, X and L are known and may be stored in memory associated with control circuit 42. Therefore, upon determining the measured resistance Z, the controller may determine the heating element's temperature T by the equation above. Alternatively, temperature T may be calculated over a range of resistances Z to create a table relating temperature to measured resistance. The table may then be stored in the control circuit's memory so that the controller, upon determining an actual measured resistance between nodes 44 and 46, may determine temperature T by reference to the table.

The control circuit 42 may be disposed in a suitable housing attached to or within blanket 18 or in a housing remote from the blanket. In either case, the control circuit may be configured for use with several different heating elements, each having a range of possible measured resistances Z that does not overlap the range of any of the other heating elements. Thus, the measured resistance Z identifies which heating element the blanket contains, and the controller can then determine temperature T from the temperature coefficient TC and nominal temperature Y for that heating element or from a lookup table for that heating element.

In operation, control circuit 42 may control the heat output of heating element 10 by various methods. Generally, however, the heating element's heat output varies predictably with current. Since triac 26 controls the amount of current passing through the heating element, the element's heat output may be determined by controlling the ratio of the triac's on-time to its off-time based on some predetermined scale.

One suitable scale is on-cycle percentage. For example, assume that the controller is programmed or otherwise configured to drive triac 26, and therefore heating element 10, in any of five settings one through five, where each setting represents a predetermined desired temperature. Assume also that the temperature for the highest setting is at or less than the temperature achieved if triac 26 is held continuously on. Each setting, then, corresponds to a percentage of cycles of the source 20 input signal during which triac 26 is activated over a given base number of cycles. For example, if the base number of cycles is 100, and setting five corresponds to continuous application of current through heating element 10, triac 26 is activated during all 100 cycles at setting five. If setting four, however, corresponds to application of 85 percent of the current level of setting five, triac 26 is then activated for 85 of the 100 cycles in each base period. Similarly, the controller under each of the other three settings activates triac 26 for a number of cycles in the base period corresponding to the relationship of the desired current level in that setting to a benchmark current level, in this case the current level under the maximum setting. It should be understood that the base period and settings described herein are provided for exemplary purposes only and that any suitable arrangement may be used.

The number of cycles used as the base period may vary as desired, as may the selection of cycles within the base period during which triac 26 is activated under the different settings. For example, assuming that the setting is 80%, the triac may be activated and deactivated for alternating cycle periods at a ratio of 4:1 (for example deactivating for every fifth cycle) or in any other suitable pattern so that the desired activation period is achieved over the base period.

In a second variation, the control circuit may be programmed to activate triac 26 based on the heating element's measured temperature. Each setting corresponds to a predetermined desired temperature for heating element 10. When control circuit 42 determines that the selected temperature has been achieved through detection of temperature T as described above, it deactivates triac 26 to stop current flow.

After a predetermined cooling period, control circuit 42 reactivates triac 26 until the heating element again reaches the predetermined temperature. Alternatively, upon deactivating triac 26, the controller periodically reactivates the triac for one-cycle periods, and determines temperature T at each activation until T falls to a threshold temperature below the predetermined temperature at which the triac was deactivated. The controller then reactivates the triac. Furthermore, the control circuit may be configured to activate and deactivate triac 26 for predetermined periods to achieve the desired temperature.

In yet another variation, the control circuit may intermittently trigger triac 26 at a predetermined phase angle in the input signal from source 20. After the triggering signal, triac 26 deactivates at the input signal's next zero-crossing, and the intermittent activating signals on lead 32 therefore intermittently open and close triac 26. Each user setting corresponds to a point in the input signal waveform prior to the zero-crossing at which the control circuit triggers triac 26. Each setting thereby corresponds to the percentage of the input waveform that is allowed to pass to the heating element and therefore corresponds to the amount of current provided to the element.

In any of these arrangements, control circuit 42 permanently deactivates triac 26 if a resistance across nodes 44 and 46 indicates that an undesirably high current level exists.

Figure 3:
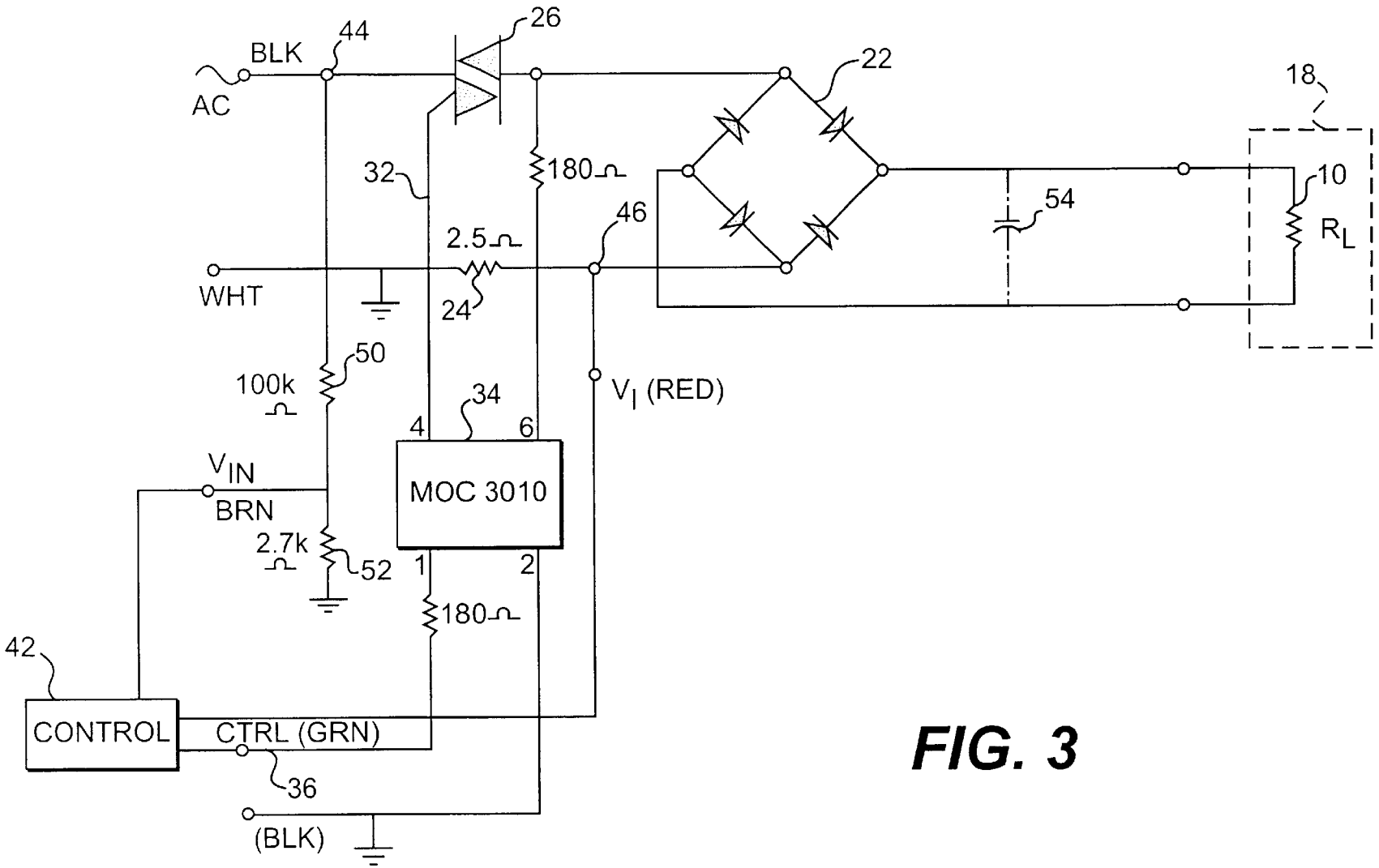
FIG. 3 is a circuit diagram of a preferred embodiment of an electric blanket constructed in accordance with the present invention.

FIG. 3 provides an electrical schematic diagram of the system in FIG. 2. Control circuit 42 measures the input voltage waveform at node 44 after the input voltage is divided down to a level at or below five volts through a voltage divider formed by resistors 50 and 52. The voltage drop across bridge circuit 22 and triac 26 is approximately constant. The control circuit measures current from node 46 across sampling resistor 24.

A user inputs a setting to the control circuit through a single push button switch (not shown) that outputs a pulse to the controller to increment the controller's present setting within the range of possible settings. Alternatively, a plurality of buttons that correspond to respective settings may be provided. To apply current to heating element 10 in response to the setting, control circuit 42 applies a control voltage to the input of optically isolated triac driver 34 which, in turn, activates triac 26 through lead 32.

The full-wave bridge 22 rectifies current to the heating element, thereby reducing the 60-Hz magnetic field. Further magnetic field reduction can be achieved by adding a filter capacitor 54 across the load.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the literal or equivalent scope of the appended claims.

What is claimed is:

1. An electric blanket, said blanket comprising:

a heating element extending through said blanket so that, upon receiving electric current from a power source, said element heats said blanket;

a resistive element having a resistance (R1) and being disposed electrically in series between said power source and said heating element;

a full-wave rectifier disposed between said power source and said heating element so that said rectifier fully rectifies said current applied to said heating element; and a regulator circuit connected to said heating element, said regulator circuit including a processor in communication with said power source and said resistive element and configured to measure a voltage drop (V1) across said power source and a voltage drop (V2) across said resistive element, wherein said processor is configured to divide V2 by R1, thereby determining a current (I)through said heating element, divide V1 by I, thereby determining a resistance (R2) having a known relationship to the resistance of said heating element, control delivery of said electric current from said power source to said heating element responsively to R2 so that said heating element heats to a desired temperature, and discontinue delivery of said electric current from said power source to said heating element when I exceeds a predetermined threshold.

2. The blanket as in claim 1, wherein said heating element is a wire wound about a core and surrounded by an insulating sheath.

3. The blanket as in claim 1, wherein said heating element is a wire having a generally circular cross-section.

4. The blanket as in claim 3, wherein said wire is at least thirty gauge.

5. The blanket as in claim 3, wherein said wire is approximately 37 gauge.

6. The blanket as in claim 1, wherein said heating element is a wire having a polygonal cross-section.

7. The blanket as in claim 1, wherein said heating element is a wire having a thermal coefficient of at least approximately 0.194%/° F.

8. The blanket as in claim 1, wherein said regulator circuit includes a connection circuit configured to connect said heating element to a power source, and a control circuit in operative communication with said connection circuit and said heating element, said control circuit configured to selectively connect said heating element to said power source through said connection circuit responsively to R2.

9. The blanket as in claim 8, wherein said connection circuit includes a first triac operatively in line between said heating element and a connection to said power source and wherein said control circuit drives a control input to said first triac.

10. The blanket as in claim 9, wherein said regulator circuit includes an optically isolated triac operatively between said control input to said first triac and a signal line in said connection circuit between said power source connection and said heating element and wherein said control circuit drives a control input to said optically isolated triac, thereby driving said control input to said first triac.

11. The blanket as in claim 8, wherein said control circuit is configured to alternatingly connect and disconnect said heating element from said power source to maintain said desired temperature.

12. The blanket as in claim 11, wherein said control circuit is configured to connect said heating element from said power source during a predetermined phase of an alternating current signal on said connection circuit.

13. The blanket as in claim 8, wherein said regulator circuit is configured to electrically disconnect said heating element from said power source upon detection of said resistance above a predetermined level.

14. The blanket as in claim 8, wherein said regulator circuit is configured to electrically disconnect said element from said power source upon detection of said resistance below a predetermined level.

15. The blanket as in claim 13, wherein said regulator circuit is configured to electrically connect said heating element to said power source after a predetermined period following said detection.

16. The blanket as in claim 12, wherein said regulator circuit is configured to electrically disconnect said heating element from said power source upon detection of said resistance above a predetermined level.

17. An electric blanket, said blanket comprising:

a heating element wire wound about a core and extending through said blanket so that, upon receiving electric current from a power source, said heating element heats said blanket;

a first triac operatively in line between said heating element and a connection to a power source;

an optically isolated triac operatively between a control input to said first triac and a signal line between said power source connection and said heating element so that activation of said optically isolated triac activates said first triac to deliver electric current from said power source connection to said heating element;

a resistive element having a resistance (R1) and being disposed electrically in series between said power source and said heating element;

a full-wave rectifier disposed between said power source and said heating element so that said rectifier fully rectifies said current applied to said heating element; and a processor in communication with said power source and said resistive element and configured to measure a voltage drop (V1) across said power source and a voltage drop (V2) across said resistive element, wherein said processor is configured to divide V2 by R1, thereby determining a current (I) through said heating element, divide V1 by I, thereby determining a resistance (R2) having a known relationship to the resistance of said element, and activate said optically isolated triac responsively to R2 so that said element heats to a desired temperature, and discontinue delivery of said electric current from said power source to said element when I exceeds a predetermined threshold.

18. The blanket as in claim 17, wherein said processor is configured to alternatingly activate and deactivate said first triac to maintain said desired temperature.

19. The blanket as in claim 18, wherein said processor is configured to activate said first triac during a predetermined phase of an alternating current signal on a signal line between said power source connection and said heating element.

20. The blanket as in claim 17, wherein said processor is configured to deactivate said first triac upon detection of R2 above a predetermined level.

21. The blanket as in claim 17, wherein said processor is configured to deactivate said first triac upon detection of R2 below a predetermined level.

22. The blanket as in claim 20, wherein said processor is configured to activate said first triac after a predetermined period following said detection.

23. The blanket as in claim 19, wherein said processor is configured to deactivate said first triac upon detection of R2 above a predetermined level.

24. A method for heating an electric blanket, said method comprising the steps of:

providing a heating element extending through said blanket so that, upon receiving electric current from a power source, said heating element heats said blanket;

fully rectifying said current applied to said heating element;

measuring a voltage drop (V1) across said power source and a voltage drop (V2) across a resistive element in series between said power source and said heating element, wherein said resistive element has a known resistance (R1);

dividing V2 by R1, thereby determining a current (I) through said heating element;

dividing V1 by I, thereby determining a resistance (R2) having a known relationship to the resistance of said heating element;

controlling delivery of said electric current from said power source to said heating element responsively to R2 so that said heating element heats to a desired temperature; and discontinuing delivery of said electric current from said power source to said heating element when I exceeds a predetermined threshold.

25. The method as in claim 24, wherein said controlling step includes alternatingly connecting and disconnecting said heating element from said power source to maintain said desired temperature.

26. The method as in claim 25, wherein said controlling step includes connecting said heating element from said power source during a predetermined phase of an alternating current signal for said power source.

27. The method as in claim 24, wherein said controlling step includes electrically disconnecting said heating element from said power source upon detection of R2 above a predetermined level.

28. The method as in claim 24, wherein said controlling step includes electrically disconnecting said heating element from said power source upon detection of R2 below a predetermined level.

29. The method as in claim 27, wherein said controlling step includes electrically connecting said heating element to said power source after a predetermined period following said detection.

30. The method as in claim 26, wherein said controlling step includes electrically disconnecting said heating element from said power source upon detection of R2 above a predetermined level.

31. An electric blanket, said blanket comprising:

a heating element extending through said blanket so that, upon receiving an alternating electric current from a power source, said element heats said blanket; and a regulator circuit connected to said heating element, said regulator circuit configured to measure the resistance of said heating element and to control delivery of said electric current from said power source to said heating element responsively to said resistance so that said heating element heats to a desired temperature, wherein said regulator circuit is configured to deliver said electric current to said heating element in at least one predetermined ratio of cycle on-time to cycle off-time, based on a predetermined scale, and wherein said predetermined ratio is associated with said desired temperature and is less than one.

32. The blanket as in claim 31, wherein said regulator circuit is configured to selectively deliver said electric current to said heating element in any of a plurality of said ratios, and wherein each said ratio is associated with a said desired temperature different from said desired temperature associated with each other said ratio.

33. The blanket as in claim 31, wherein said predetermined scale is defined by a predetermined number of cycles of said current delivered to said heating element during a predetermined number of consecutive cycles of said current.

34. The blanket as in claim 33, wherein said predetermined number of cycles delivered to said heating element are consecutive.

35. The blanket as in claim 36, wherein said predetermined scale is defined by a predetermined phase during each cycle of said current during which said current is delivered to said heating element.

36. An electric blanket, said blanket comprising:

a heating element extending through said blanket so that, upon receiving an alternating electric current from a power source, said element heats said blanket; and a regulator circuit connected to said heating element, said regulator circuit including memory and being configured to measure the resistance of said heating element, determine a first temperature of said heating element corresponding to said resistance, and control delivery of said electric current from said power source to said heating element responsively to said temperature so that said first temperature changes toward a desired temperature, wherein said regulator circuit includes memory in which is stored a value corresponding to the length of said heating element, a value corresponding to a temperature coefficient of said heating element and a value corresponding to a rated resistance of said heating element, and wherein said regulator circuit is configured to calculate said first temperature based on said length, said temperature coefficient and said rated resistance.

37. An electric blanket, said blanket comprising:

a heating element extending through said blanket so that, upon receiving an alternating electric current from a power source, said element heats said blanket; and a regulator circuit connected to said heating element, said regulator circuit including memory and being configured to measure the resistance of said heating element, determine a first temperature of said heating element corresponding to said resistance; and control delivery of said electric current from said power source to said heating element responsively to said temperature so that said first temperature changes toward a desired temperature, wherein said regulator circuit includes memory in which is stored a plurality of tables, each table including a plurality of said first temperatures and a range of resistances respectively corresponding to said first temperatures, wherein said ranges are non-overlapping and respectfully correspond to a plurality of different said heating elements, and wherein said regulator circuit is configured to select said range within which said heating element resistance falls and to select one of said first temperatures corresponding to said selected range based on a comparison of said heating element resistance to said resistances within said selected range.

38. The blanket as in claim 37, wherein each said heating element resistance corresponds to a said first temperature based on the length of said heating element, the temperature coefficient of said heating element and the rated resistance of said heating element.

* * * * *